United States Patent [19]

Brusasco

[11] Patent Number: 4,872,714

[45] Date of Patent: Oct. 10, 1989

[54] ELECTRICALLY-POWERED VEHICLE LOCK

[75] Inventor: Enzo Brusasco, Turin, Italy

[73] Assignee: Roltra S.p.A., Turin, Italy

[21] Appl. No.: 107,968

[22] Filed: Oct. 13, 1987

[30] Foreign Application Priority Data

Oct. 17, 1986 [IT] Italy ..... 67788 A/86

[51] Int. Cl.[4] ..... E05C 3/26; E05B 47/00

[52] U.S. Cl. ..... 292/201; 292/216

[58] Field of Search ..... 292/201, DIG. 43, 216, 292/336.3, 280

[56] References Cited

U.S. PATENT DOCUMENTS 4,395,064 7/1983 Bellot et al. ..... 292/201
4,597,598 7/1986 Bascou ..... 292/201 X
4,624,491 11/1986 Vincent ..... 292/201

FOREIGN PATENT DOCUMENTS 1199596 4/1984 Italy

*Primary Examiner*—Richard E. Moore
*Attorney, Agent, or Firm*—Gifford, Groh, Sheridan, Sprinkle and Dolgorukov

[57] ABSTRACT

An electrically-powered motor vehicle lock comprising two electrical actuators for respectively closing and opening the lock, and a control unit for activating the aforementioned actuators and automatically resetting the same after each operation.

7 Claims, 4 Drawing Sheets

ELECTRICALLY-POWERED VEHICLE LOCK

BACKGROUND OF THE INVENTION

The present invention relates to an electrically-powered lock for vehicles, particularly motor vehicles. On known vehicle locks, one or more electrical actuators, usually d.c. motors, activate appropriate gearing for moving the lock from a partially-closed position, achieved by manually closing the vehicle door, into a fully-closed position, and for opening the lock subsequent to operation of a key, handle, push-button, or similar.

Known locks of the type briefly described above present a number of drawbacks. First and foremost, they are usually fairly expensive, both on account of the cost of the electrical components involved, and the complexity of the mechanical components required (linkages, transmissions, etc.), which inevitably results in higher production, assembly and control costs.

Furthermore, locks of the aforementioned type must also allow for emergency mechanical operation in the event of a breakdown on the vehicle electrical system. This means either using additional gearing for disconnecting the electrical actuators and relative gear chains from the actual lock mechanisms (fork and retainer), or the acceptance of considerable effort, as compared with a traditional mechanical lock, for emergency mechanical operation.

SUMMARY OF THE INVENTION

The aim of the present invention is to provide an electrically-powered vehicle lock designed to overcome the drawbacks associated with known locks of the aforementioned type.

With this aim in view, according to the present invention, there is provided an electrically-powered vehicle lock comprising:

a rotary fork having a cavity engaged by a striker integral with a fixed part of the vehicle, and designed to turn between a first partially-closed position and a second fully-closed position;

a retaining element designed to retain the said fork in one of the said closed positions; and lever type opening means designed to cooperate with the said retaining element against the action of elastic means, for releasing the said fork;

characterised by the fact that it comprises first electrical actuating means designed to cooperate with the said fork in such a manner as to move it from the said partially-closed position into the said fully-closed position; and second electrical actuating means designed to cooperate with the said lever type opening means; the said lock also comprising control means for automatically restoring the said electrical actuating means to a respective idle position, subsequent to each operation.

BRIEF DESCRIPTION OF THE DRAWINGS

A preferred non-limiting embodiment of the present invention will be described with reference to the accompanying drawings, in which.

DETAILED DESCRIPTION OF THE INVENTION

Figure 1:
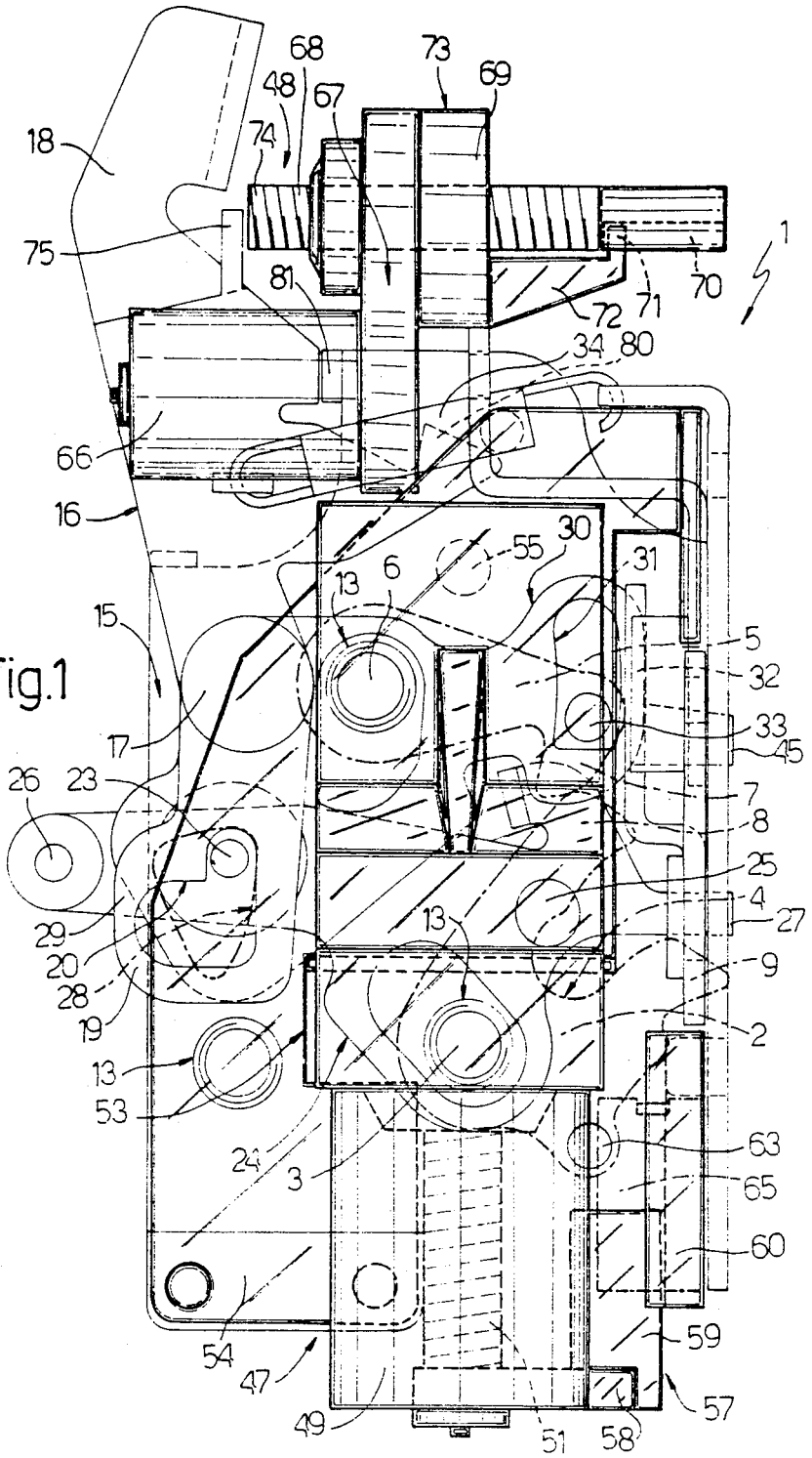
FIGS. 1 and 2 show respective front and side views of an electrically-powered lock in accordance with the teachings of the present invention.
Figure 2:
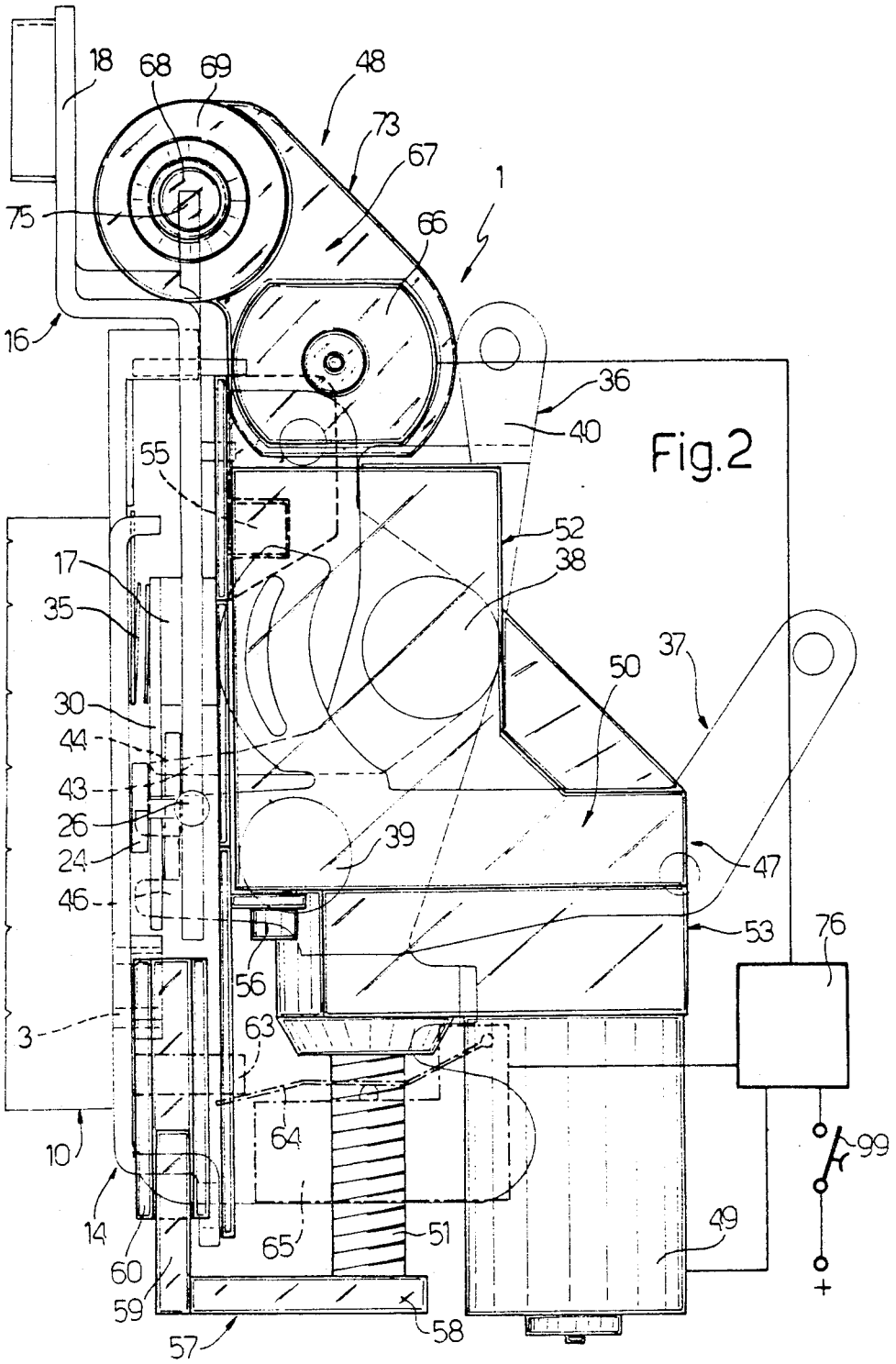

Number 1 in FIGS. 1 and 2 indicates an electrically-powered lock, particularly for a motor vehicle door. The said lock 1 comprises, in known manner, a fork 2 designed to turn about a pin 3, and having a cavity 4 engaged by a striker (not shown) integral with a fixed part of the vehicle. A retainer 5, designed to turn about a second pin 6, is forced by a spring (not shown) against the said fork 2, and presents a hook-shaped end portion 7 which may engage one of the two teeth, 8, 9, located on either side of the said cavity 4 on fork 2.

Fork 2 and retainer 5 are housed inside an outer casing 10 connected by means of three screws 13 to a frame 14 supporting a lever mechanism for activating lock 1 and indicated as a whole by 15.

The said lever mechanism 15 is substantially of known type and comprises a control lever 16 designed to turn about a multiple hinge 17. The said control lever 16 comprises a shaped, elongated top arm 18, and a shorter bottom arm 19 having a substantially L-shaped slot 20. The said slot 20 is engaged, in sliding manner, by a pin 23 integral with a safety lever 24 designed to turn about a second hinge 25. The said safety lever 24 presents a spherical node element 26 and a tooth 27, located at opposite ends of lever 24, on the pin 23 and hinge 25 side respectively.

Pin 23 also engages, in sliding manner, a substantially triangular slot 28 formed on arm 29 of a substantially square transmission lever 30. The said lever 30, which is hinged to the said multiple hinge 17, presents a substantially vertical, slightly curved slot 31 on the end of its opposite arm 32, which slot 31 is engaged, in sliding manner, by a pin 33 integral with end portion 7 of retainer 5.

Control and transmission levers 16 and 30 are connected to respective springs 34 (FIG. 1) and 35 (FIG. 2) which secure them clockwise in the position shown in FIG. 1. Lever mechanism 15 also comprises a lever 36, for opening the lock from inside the vehicle, and a lever 37 for activating safety lever 24; which levers 36 and 37 are hinged by respective pins 38 and 39 to the said frame 14, in a plane perpendicular to that of levers 16, 24 and 30. The said lever 36 comprises an arm 40 extending substantially upwards and outside lock 1; and a substantially horizontal arm 43 having a decreasing section and the end 44 of which may cooperate, in a manner not shown, with a tooth 45 extending from arm 32 of transmission lever 28. Similarly, lever 37 controls the said safety lever 24, the tooth 27 of which engages the fork-shaped end 46 of lever 37 itself.

According to the present invention, lock 1 comprises two electrical actuators, 47 and 48, for respectively closing and opening lock 1. Actuator 47 consists of a vertical-axis, d.c. electric motor 49 which, via a gear reduction unit 50, activates a known, e.g. recirculating-ball, screw-nut screw pair 51, 52, in such a manner that operation of electric motor 49 results in displacement of vertical screw 51. Actuator 47 is housed inside an outer body 53 secured to a supporting bracket 44 integral with frame 14 of lock 1, by means of a reference pin 55 and one or more screws 56.

The bottom end of screw 51 is connected to a square body 57 comprising a substantially rectangular-section element 58 having its axis perpendicular to that of screw 51, and a second element 59 designed to travel along a prismatic guide 60 integral with frame 14. The said element 59 is designed to intercept a pin 63 integral with fork 2, which pin 63, in the FIG. 2 configuration, is located contacting the blade 64 of a microswitch 65.

Similarly, actuator 48 comprises an electric motor 66 connected, via a gear reduction unit 67, to a recirculatingball screw-nut screw pair 68, 69. In this case, displacement of horizontal screw 68 is determined by a prismatic guide consisting of a longitudinal outer groove 70 formed in an end portion of srew 68 itself, and by a projection 71 which engages screw 68 and is supported on a bracket 72 integral with a fixed outer frame 73 on the said actuator 48. The opposite end 74 of screw 68 is designed to cooperate with a striker 75 integral with top arm 18 of control lever 16.

Figure 8:
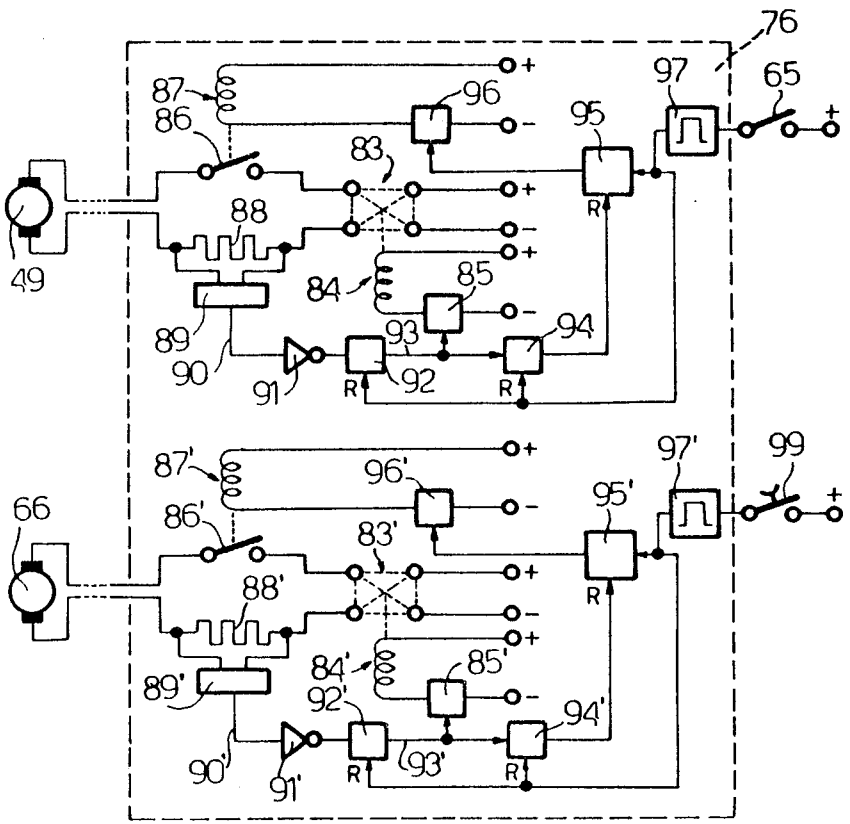
FIG. 8 shows an electric diagram of the control system on the lock according to the present invention.

Electric motors 49 and 66 are connected electrically to a control unit 76, operation of which is described in detail later on, and to which microswitch 65 is also connected. In more detail, and as shown schematically in FIG. 8, electric motor 49 is supplied by d.c. voltage terminals via a dual switch 83 having four terminals which may be connected directly or cross-connected (for inverting the current on motor 49) by the coil of a control relay 84, which coil is supplied by d.c. voltage terminals via a switch block 85 consisting, for example, of a transistor. On the branches supplying motor 49, there are series-connected a switch 86 controlled by the coil of a relay 87, and a calibrated resistor 88, which acts as a sensor for detecting supply current to motor 49. Parallel with the said resistor 88, there is connected a circuit 89, for example, of the type described in Italian Patent Application N.83618-A/84 of 16/4/1984, which circuit detects the presence or absence of normal variations in the supply current to motor 49, and supplies a corresponding, e.g. logic-level, output signal 90. Via an inverter 91, the said signal 90 is sent to a flip-flop circuit block 92, the output signal 90 of which constitutes a control signal for switch block 85, and also goes to a flip-flop ciruit block 94 which acts as a frequency divider. The output of block 94 goes to the reset input of a further flip-flop circuit block 95, the output of which controls a switch block 96 on the circuit supplying the coil of relay 87.

Microswitch 65 is connected between a positive supply terminal and a pulse forming circuit 97, the output of which is connected to the input of block 95, and to the reset inputs of blocks 92 and 94.

The circuit controlling motor 66 is connected in the same way as for motor 49, the corresponding blocks being indicated by the same reference numbers plus a ′ sign. The only exception is number 99, which indicates a push-button switch for opening lock 1 and which operates in the same way as microswitch 65.

Operation of lock 1 is as follows.

Figure 3:
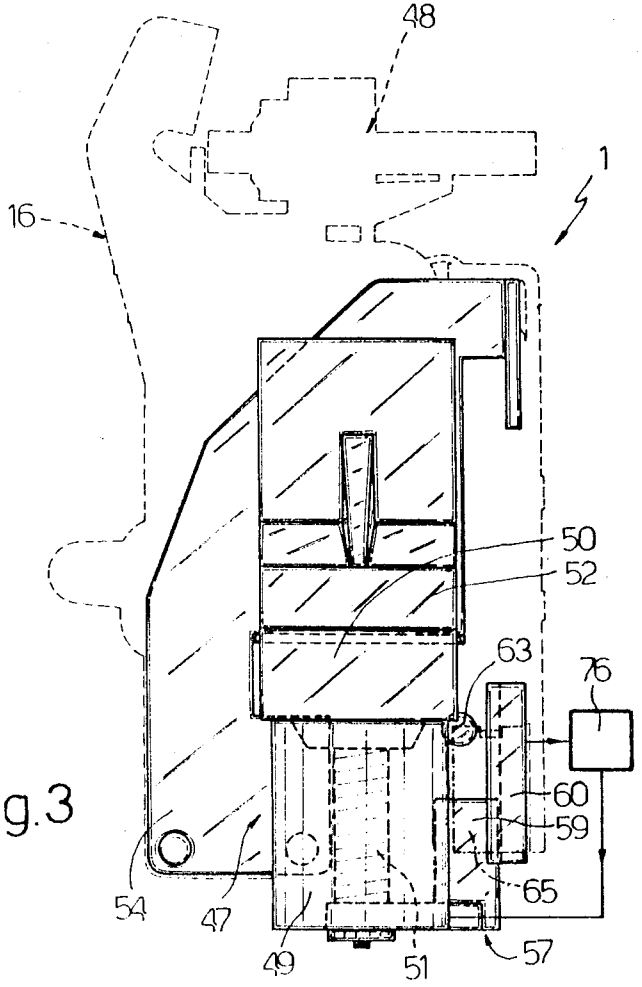

In the open-lock condition shown in FIG. 2, pin 63, integral with fork 2, acts on blade 64 so as to keep microswitch 65 open. Consequently (FIG. 8), no enabling signal is sent to block 97, with the result that switch block 96 and switch 86 remain open, and motor 49 remains off. When the vehicle door is closed manually, the fixed striker engages cavity 4 on fork 2, thus producing a first limited rotation of fork 2 (anticlockwise in FIG. 1). Pin 63 therefor releases blade 64 on microswitch 65 (FIG. 3), which therefore switches (FIG. 8) and, via block 97, resets flip-flop circuit blocks 92 and 94 and, conveniently after a short delay, enables block 95 so as to close switch block 96. Via relay 87, therefore, switch 86 closes and motor 49 is started up in the direction determined by a first position of dual switch 83, wherein switch block 85 is opened and signal 93 at the output of block 92 is reset.

Figure 4:
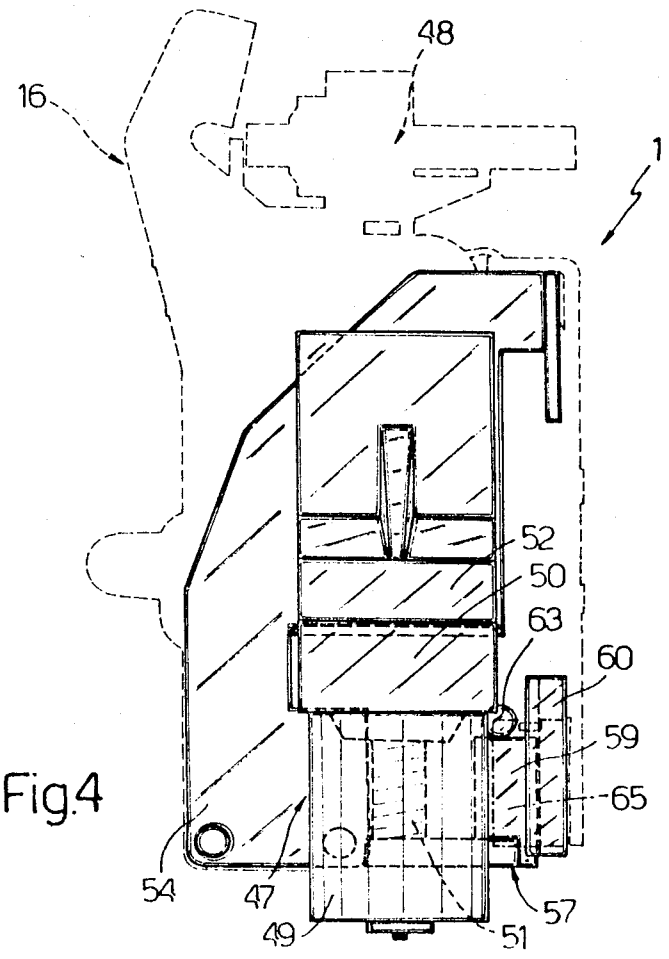
FIGS. 3, 4, 5, 6 and 7 show smaller-scale, partial front views of the lock in FIGS. 1 and 2 in various operating positions.
Figure 5:
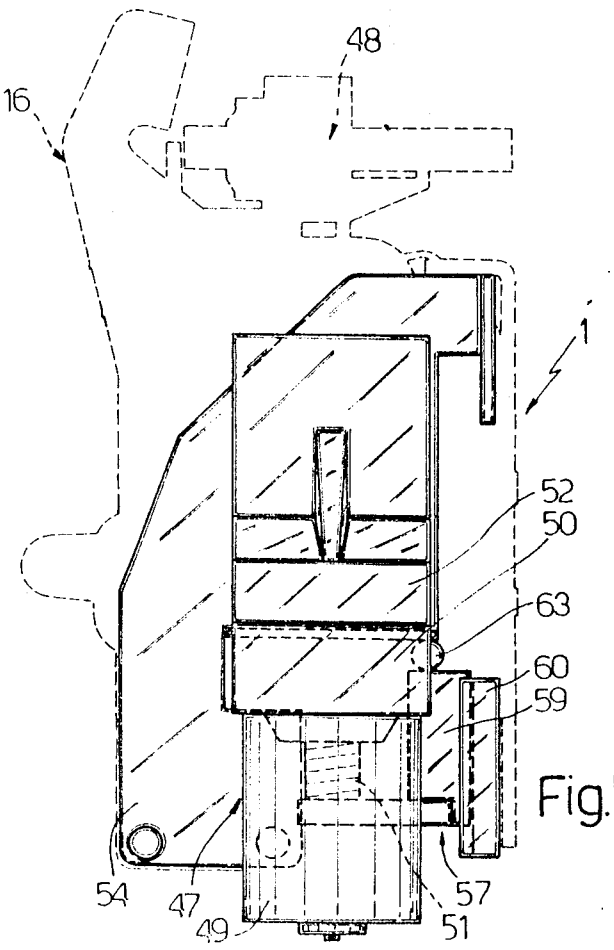

Electric motor 49 therefore causes screw 51 to move upwards, together with integral square body 57, the sliding element 59 of which first approaches pin 63 (FIG. 4) and then pushes it upwards so as to turn fork 2 and fully close lock 1 (FIG. 5), in which position the end portion 7 or retainer 5 engages tooth 9 on fork 2.

When sliding element 59 reaches the top limit stop on guide 60, the increasing torque stalls motor 49. Control unit 76 detects the arrest of motor 49 via block 89 which, detecting no variation in supply current, supplies a logic-level 1 signal to block 92, the output signal of which switches to level 1 so as to close switch block 85 and so supply relay 84. The said relay 84 switches dual switch 83 so as to invert the current on motor 49 which, operating in reverse, automatically restores screw 51 to the position shown in FIG. 2.

During reverse operation of motor 49, signal 93 at the output of block 92 remains unchanged, and therefore also the position of dual switch 83. When motor 49 is again arrested in the said idle position, this is detected by block 85 which supplies a further logic-level 1 signal to block 92, the output signal 93 of which switches to logic level 0. The logic-level 1 signal now at the output of block 94 therefore resets block 95 so as to open switch block 96, de-energise relay 87, and open switch 86 for cutting off supply to motor 49. At the same time, logiclevel 0 signal 93 opens switch block 85 so as to deenergise relay 84 and restore dual switch 83 to its initial position, wherein electric motor 49 may again be supplied in the direction enabling upward displacement of screw 51, subsequent to closure of the vehicle door again closing microswitch 65 as already described. This is, obviously dependent on the vehicle door having been opened in the meantime, so as to release fork 2 and turn pin 63 back clockwise into the FIG. 2 position, wherein it acts on blade 64 for opening microswitch 65 (such opening has no effect on block 97).

Figure 6:
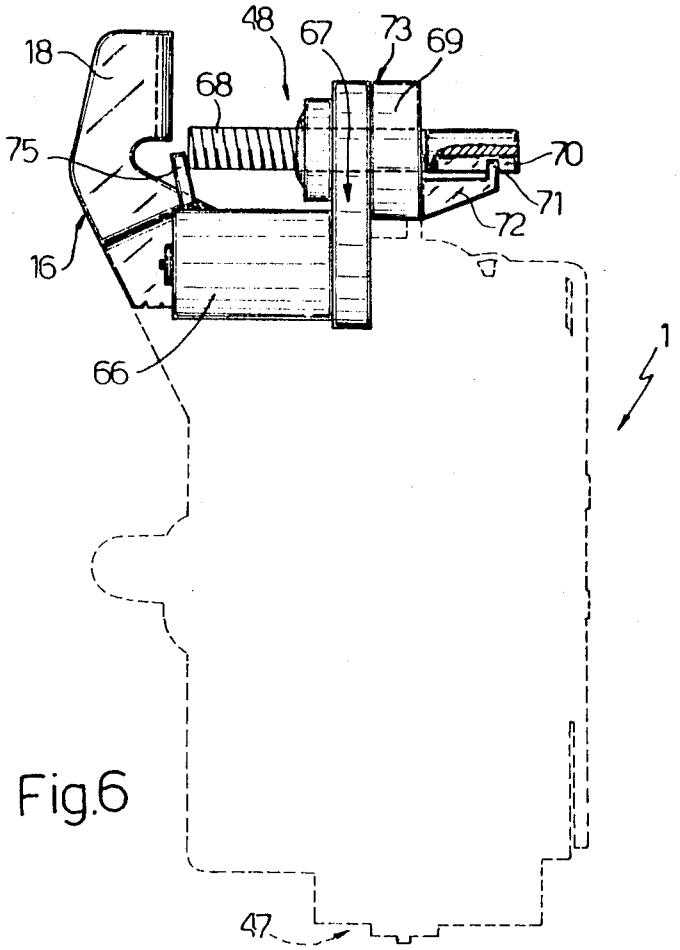
Figure 7:
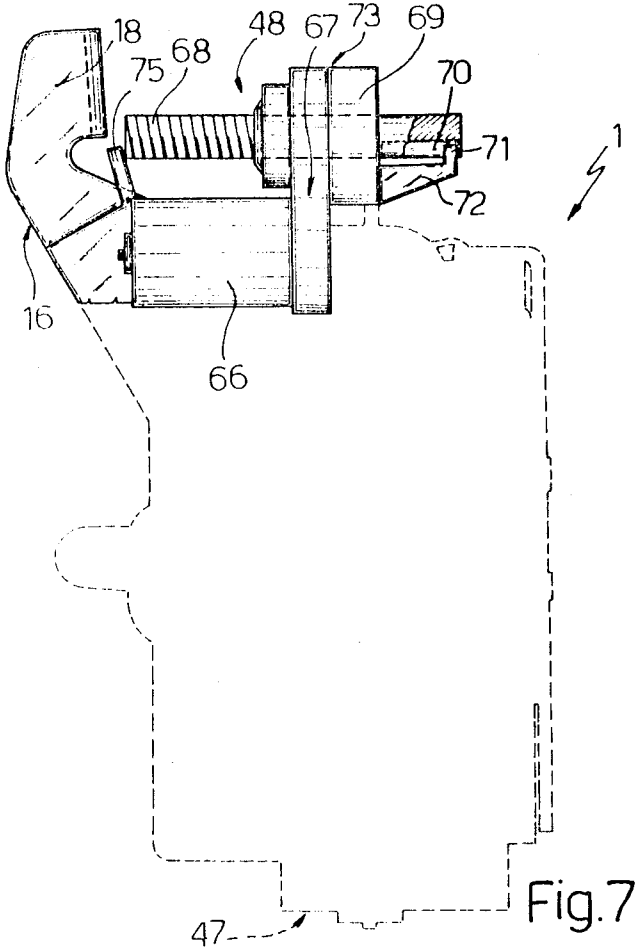

Lock 1 is opened by means of a key from outside the vehicle, or by means of a push-button from the inside, or a handle, which closes switch 99 (FIG. 8) and, as already described in connection with operation of microswitch 65, supplies motor 66 : screw 68 moves leftwards (in FIG. 1) and end 74 on the said screw cooperates with striker 75 on lever 16 (FIGS. 6 and 7) so as to turn it anticlockwise.

If lever 26 is positioned as shown in FIG. 1 (safety disconnected), lever 16 moves pin 23 so as to turn transmission lever 30 anticlockwise. This causes arm 32 on transmission lever 30 to move upwards, thus causing slot 31 to pull on pin 33 of retainer 5, which turns anticlockwise so as to release fork 2, which clicks open by virtue of traditional elastic means not shown.

In this case, too, upon lever 16 being arrested (by tooth 80 on lever 16 contacting projection 81 on frame 14), supply to electric motor 66 is inverted by control unit 76, by virtue of sensor circuit 89′. Finally, upon screw 68 being arrested in the rightmost limit position, electrical supply is cut off by switch 86′ opening again by virtue of sensor circuit 89′, in the same manner as already described in connection with motor 49. Lever 16 is also restored to the FIG. 1 position by virtue of spring 34. Safety lever 24 operates in the same way as on a traditional mechanical lock. When lever 24 is turned anticlockwise (FIG. 1) from outside the vehicle, using a key, or from inside using a knob (connected by known gearing, not shown, to element 26 and safety operating lever 37 respectively), pin 23 is moved into the bottom portion of slot 20 on lever 16, which may thus be turned with no effect. In the event of a breakdown on the electrical system, lock 1 may be operated mechanically in exactly the same way as a traditional mechanical lock. For closing the lock, the door need simply be banded, so as to fully rotate fork 2 and engage retainer 5 on second tooth 9. For opening it, lever 16 may be operated mechanically to obtain the same result already described in connection with electrical operation.

The advantages of the lock according to the present invention will be clear from the foregoing description. Firstly, electrical operation is achieved using two straightforward, low-cost actuators conveniently mounted on the lock itself. Secondly, the mechanical part is identical to that of a traditional mechanical lock, and involves no additional components, no increase in complexity, and no additional effort in the event of emergency mechanical operation.

To those skilled in the art it will be clear that changes may be made to lock 1 as described and illustrated herein without, however, departing from the scope of the present invention.

For example, in place of the said sensors, the electric motors may be arrested using electromechanical limit switches (microswitches), or other types of sensors (e.g. thermal-electric). Furthermore, the lock may be designed to perform additional functions, such as those of an electrically-powered security door lock. Finally, the functions of the two electrical actuators could be performed using a single electric motor, with appropriate gearing for opening and closing the lock, and a specific control circuit.

I claim:

1. An electrically-powered vehicle lock comprising:

a rotary fork having a cavity for engagement with a striker integral attached to a fixed portion of a vehicle, said fork designed to turn between a first partially-closed position and a second fully-closed position;

a retaining element for retaining said fork in one of said first or second positions;

means for releasing said fork and comprising a first electrical actuating means to move said fork from said partially-closed position to said fully-closed position; and second electrical actuating means to move said fork from said fully-closed position to said partially closed position; and;

control means for automatically restoring said first and second electrical actuating means to respective idle positions, subsequent to each fork rotation operation, wherein said actuating means act in the reverse direction of the initial actuation to reach respective idle positions.

2. A lock as claimed in claim 1, wherein said first and second actuating means individually comprise a d.c. electric motor and a screw with nut screw combination activated by an electric motor via speed reducing means.

3. A lock as claimed in claim 2, wherein said nut screw is a recirculating-ball type.

4. A lock as claimed in claim 2, wherein said first and second actuating means further comprises: prismatically- guided elements for preventing rotation of the said screw while displacing said screw in a linear direction, wherein said prismatically-guided elements of said first actuating means further comprises a fixed guide and a sliding body integral with said screw, said sliding body engaging said fork and moving said fork from said partially-closed position to said fully-closed position.

5. A lock as claimed in claim 1 and further comprising:

a first microswitch for activating said first actuating means wherein said first switch is activated by said fork in said partially closed position; and a second microswitch for activating said second activating means wherein said second switch is activated by the user.

6. A lock as claimed in claim 1, wherein said control means comprise means for detecting arrest of said actuating means and means for reversing said actuating means into said idle position.

7. A lock as claimed in claim 6, wherein said means for detecting said arrest condition comprise at least a circuit for detecting variations in the current supplied to respective electric motors on said actuating means.

* * * * *